US008431092B2

(12) United States Patent
Anderson et al.

(10) Patent No.: US 8,431,092 B2
(45) **Date of Patent: *Apr. 30, 2013**

(54) BIOCHIP HOLDER AND METHOD OF COLLECTING FLUID

(75) Inventors: Clifford L. Anderson, Tempe, AZ (US); Roberta L. Druyor-Sanchez, Mesa, AZ (US); Roy Taylor Mast, Chandler, AZ (US); Sangeet Singh-Gasson, Highland Park, IL (US)

(73) Assignee: GE Healthcare Bio-Science AB, Uppsala (SE)

( * ) Notice: Subject to any disclaimer, the term of this patent is extended or adjusted under 35 U.S.C. 154(b) by 649 days.

This patent is subject to a terminal disclaimer.

(21) Appl. No.: 12/212,718

(22) Filed: Sep. 18, 2008

(65) Prior Publication Data

US 2009/0018034 A1 Jan. 15, 2009

Related U.S. Application Data

(63) Continuation of application No. 10/183,891, filed on Jun. 26, 2002, now Pat. No. 7,442,342.

(51) Int. Cl.
*B01L 9/00* (2006.01)

(52) U.S. Cl.
USPC ..... 422/563; 422/561; 269/21

(58) Field of Classification Search ..... 422/563, 422/561, 523; 269/21; 324/750.2
See application file for complete search history.

(56) References Cited

U.S. PATENT DOCUMENTS

| | | | | |
|---|---|---|---|---|
| 5,300,881 | A * | 4/1994 | Ferrer et al. | 324/750.2 |
| 5,415,846 | A | 5/1995 | Berry, Jr. | |
| 5,620,894 | A | 4/1997 | Barger et al. | |
| 6,040,193 | A | 3/2000 | Winkler et al. | |
| 6,189,876 | B1 * | 2/2001 | Frazier | 269/21 |
| 6,695,803 | B1 * | 2/2004 | Robinson et al. | 604/4.01 |
| 2003/0235521 | A1 | 12/2003 | Shea et al. | |

FOREIGN PATENT DOCUMENTS

| | | |
|---|---|---|
| EP | 1 033 577 | 9/2000 |
| WO | WO 01/45843 | 6/2001 |
| WO | WO 01/54814 | 8/2001 |
| WO | WO 01/67112 | 9/2001 |

* cited by examiner

*Primary Examiner* — Natalia Levkovich

(57) ABSTRACT

A biochip holder is disclosed, the holder including a means to receive a biochip, a vacuum port in communication with the received biochip, and a vacuum source connected to the vacuum port. Liquid from flushing of the biochip is pulled by vacuum force into a vacuum port and can be collected in order to prevent cross-contamination of the biochip. A method of collecting fluid from such a biochip is also disclosed.

5 Claims, 3 Drawing Sheets

- PRIOR ART -

BIOCHIP HOLDER AND METHOD OF COLLECTING FLUID

CROSS-REFERENCE TO RELATED APPLICATIONS

This application is a continuation of U.S. patent application Ser. No. 10/183,891 filed Jun. 26, 2002; the disclosure of which is incorporated herein by reference in its entirety.

BACKGROUND OF THE INVENTION

Advances in molecular biology have seen a dramatic increase in the use and need of high capacity assays in testing and analyzing biological substrates or reactions. Existing technology utilizes the binding of molecules contained within a biologically reactive sample fluid, known as a target molecule, onto molecules contained within biologically reactive sites, known as probe molecules. Binding commonly occurs on an apparatus referred to as a biochip, which includes one or more ordered microscopic arrays of biologically reactive sites immobilized on the surface of a substrate, commonly glass. A biologically reactive site can be created by dispensing a small volume of a fluid containing a biological reagent onto a discrete location on the surface of a substrate. Previous assays were originally developed in research laboratories and performed by highly skilled individuals. Adapting these procedures to clinical uses, such as diagnostics, forensics and other applications, has produced the need for equipment and methods that allow less-skilled operators to effectively perform the assays under higher capacity, less stringent assay conditions.

Biochips are advantageously used to perform biological reactions on their surface, however, most existing apparatus are difficult to handle during such common practices as flushing the reaction site, often resulting in cross-contamination of reaction sites. A biochip with two or more assays is preferably flushed with a fluid prior to removal of its various layers in order to prevent cross-contamination between reaction sites. The fluid is typically pushed out by pipetting the appropriate volume of flush fluid into one port of the reaction chamber, causing fluid to exit a second port of the reaction chamber located separate from the first. The flushing process is messy in that the exiting fluid spills over the edge of the slide and can itself lead to cross-contamination if the exiting fluid enters the port of an adjacent reaction chamber. It is desired to remove the exiting fluid as quickly and efficiently as possible to reduce the possibility of cross-contamination.

Additionally, removal of the various layers requires some force which must be resisted by holding the biochip as a whole. The biochip is difficult to hold by hand as it often has sharp edges and can be an awkward shape and size. Bobbling of the slide during removal can also result in cross-contamination or the dropping or damaging of the biochip itself.

BRIEF SUMMARY OF THE INVENTION

It is an object of the present invention to provide an apparatus to hold the biochip during flushing and collecting of the exiting fluid to avoid cross-contamination. It is another object of this invention to provide an apparatus that allows for the quick and efficient collection of exiting fluid during flushing of the biochip. It is also an object of the present invention to provide means for holding the biochip to provide resistance during removal of the various layers of the biochip. It is a further object of the invention to provide an apparatus for resisting force on the biochip during removal of the various layers. It is yet another object of the present invention to provide a method of collecting the exiting fluid when flushing a biochip.

DETAILED DESCRIPTION OF THE INVENTION

A brief description of the structure of a biochip is helpful in understanding the present invention which relates to manipulation and use of the biochip. Exemplary biochips suitable for use in this invention are disclosed in PCT Publication No. WO 01/54814 A2.

Figure 1:
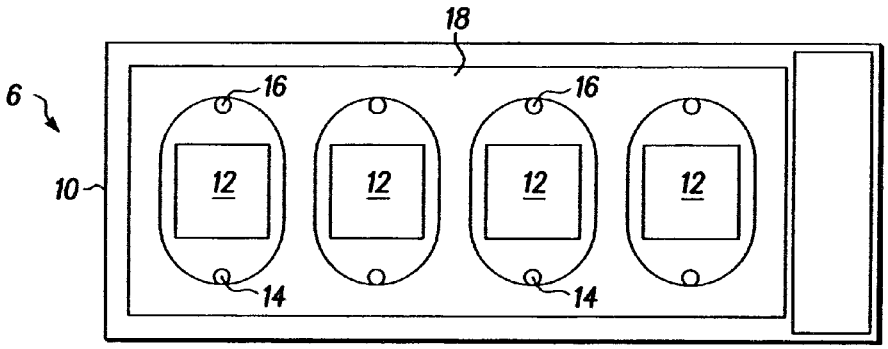
FIG. 1 is a drawing of a prior art biochip.

Referring to FIG. 1 of the prior art, a biochip 6 commonly includes a substrate 10, such as glass, metal, plastic, or ceramic, on which the active materials rest. Reaction chambers 12 define the specific areas in which each reaction site or assay is located. A flexible layer (not shown) overlies each reaction chamber. The flexible layer is preferably impermeable to liquids to avoid evaporation of water from the volume in the reaction chamber. Additionally, a label layer 18 is applied to the outer surface of the flexible layer. The label layer is used to identify and differentiate the various reaction chambers and their contents and is later removed from the biochip.

Each reaction chamber also commonly includes an inlet port 14 and an outlet port 16. The ports 14 and 16 are positioned over the substrate 10 adjacent to and in communication with the reaction chamber 12 so that fluid introduced into the inlet port 14 will flow into the reaction chamber 12 and eventually out of the outlet port 16. Such ports are preferably shaped to accept a plastic pipette tip. The ports are preferably positioned so that the inlet port 14 and the outlet port 16 are at opposite ends of the reaction chamber 12 to encourage flow of the introduced liquid through the entire reaction chamber. These ports can be used for the introduction of sample fluid or wash solutions. Fluid is introduced into the inlet port 14 and exits through the outlet port 16. Fluid flow is typically created by the force of the continual introduction of fluid into the inlet port 14, as the reaction chamber 12 has a limited volume. In previous systems, exiting flush fluid either messily spilled over the edge of the biochip or flowed into other reaction chambers or ports causing cross-contamination.

In accordance with the present invention, a biochip holder and a method are provided which encourage the flow of the flushing fluid from the outlet ports of the biochip and collection of the flushing fluid to prevent its causing cross-contamination. Generally, the technique and apparatus involve the use of a vacuum port in proximity to and downhill from the exit port of the reaction chamber.

Figure 2:
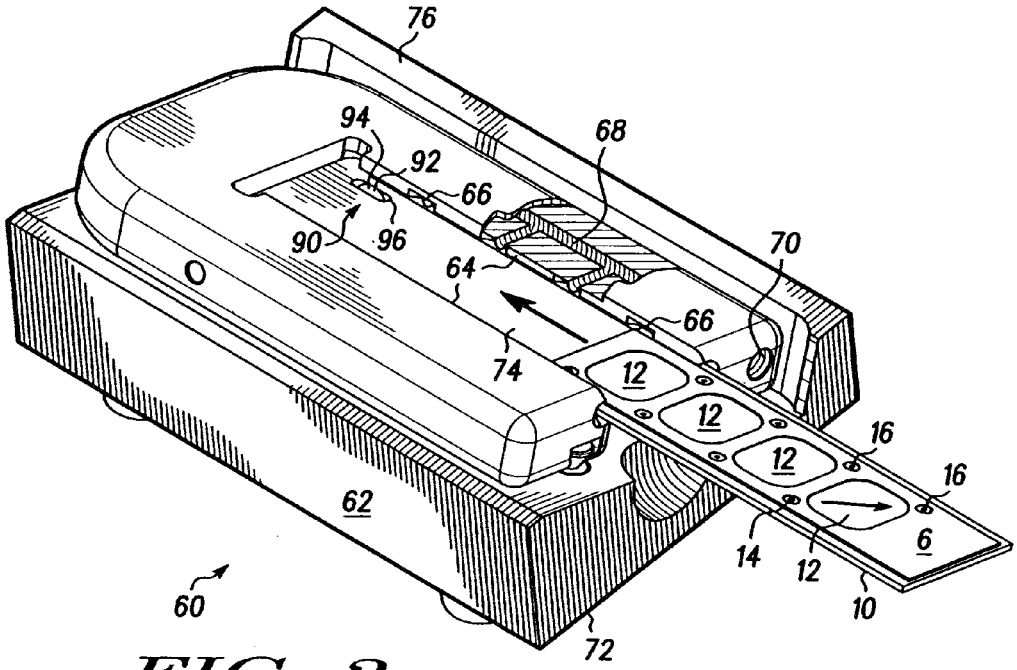
FIG. 2 is a perspective view of a preferred embodiment of a biochip holder.
Figure 3:
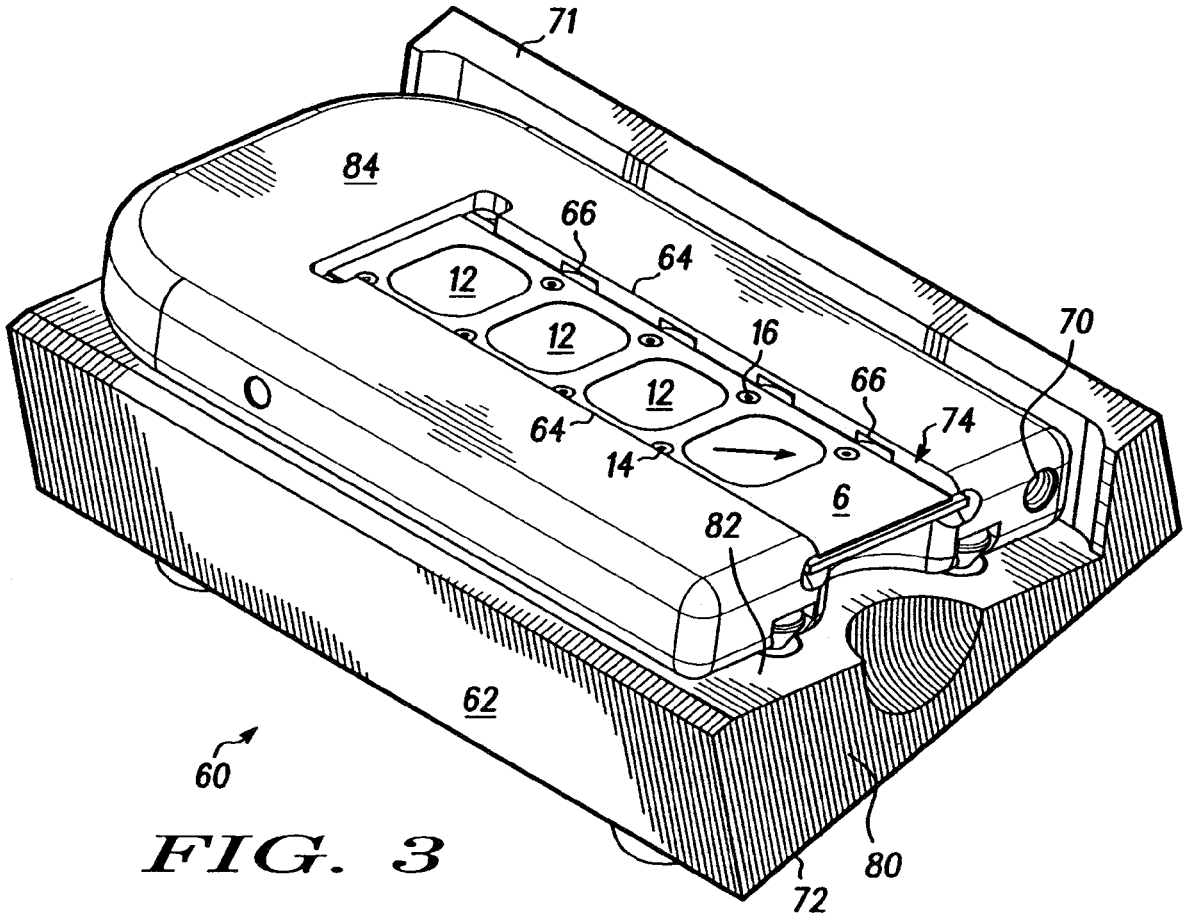
FIG. 3 is a perspective view of a preferred embodiment of a biochip holder with a biochip completed inserted.
Figure 4:
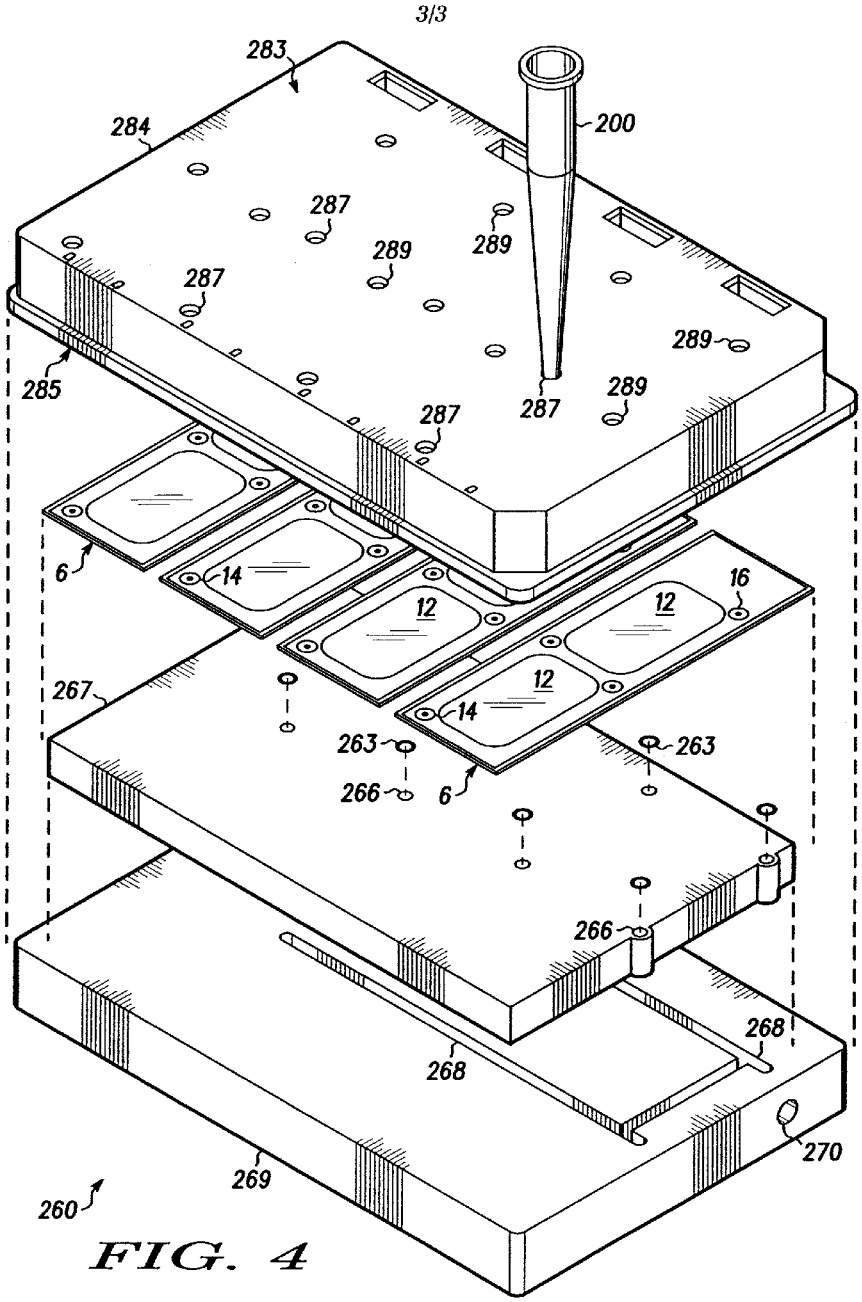
FIG. 4 is an exploded perspective view of a preferred embodiment of a biochip holder.

Generally, as shown in FIGS. 2-4 with like numerals representing like structures, a biochip holder apparatus 60 has receiving means, for example parallel rails 64, for receiving and securely holding the biochip 10 in the apparatus. The apparatus 60 additionally includes at least one vacuum port 66 adjacent the receiving means, such as parallel rails 64, which is in communication with the biochip 6, preferably near at least one outlet port 16 when the biochip is fully inserted into the receiving means. Fluid exiting the outlet port 16 can then enter the vacuum port 66. The vacuum port 66 is preferably downhill from or located such that gravity directs the fluid toward the outlet port 16. Fluid entering the vacuum port 66 flows into a vacuum chamber 68, which is preferably a part of the apparatus 60 and is in fluid communication with the vacuum port 66. A vacuum passage 70, which is in communication with the vacuum chamber 68, is acted upon by a vacuum source (not shown) which draws the fluid from the vacuum chamber 68 through the vacuum passage 70 to a collection device (not shown). As the vacuum passage 70 is in fluid communication with the vacuum chamber 68, which is in fluid connection with the vacuum ports 66, which is in fluid connection with the surface of the biochip 6, the vacuum source is acting upon the biochip 6, preferably the vicinity of the outlet ports 16, and drawing the fluid through the biochip holder apparatus to be collected outside of the apparatus.

The vacuum passage 70 is capable of receiving connection to a vacuum source which then acts on the vacuum chamber 68. In a preferred embodiment, the vacuum passage 70 is a threaded opening which can receive a threaded fitting for connecting tubing leading to an external vacuum flask (not shown), a technique well-known to those skilled in the art. Activation of a vacuum source attached to the vacuum flask thereby acts upon the tubing which thereby acts upon the vacuum chamber 68 via the vacuum passage 70. Drawing a vacuum on the vacuum chamber 68 acts upon the vacuum ports 66 and draws fluid from the biochip 6, particularly the vicinity of the outlet ports 16, toward the vacuum chamber 68 via the vacuum ports 66.

The vacuum source acting on the biochip holder via the vacuum flask draws flush fluid from the vicinity of the outlet ports 16, into the vacuum ports 66, which leads into the vacuum chamber 68. As would be understood by one skilled in the art, the fluid is then preferably sucked out of the vacuum chamber 68 through the vacuum passage 70, through tubing leading to the external vacuum flask where the fluid would come to rest and be collected. The flask is preferably of sufficient volume to collect fluid from several biochips before requiring the disconnection and emptying of the vacuum flask. The use of an external vacuum flask to collect the flush fluid increases the number of biochips that can be flushed between emptying of the collected fluid and reduces the chances of collected fluid leaking back to the biochip.

Alternatively, the vacuum chamber 68 can collect the flush fluid where the vacuum source is directly connected to the vacuum passage 70 or lacks an external vacuum flask. In such a case, the vacuum passage 70 is located so that fluids received in the vacuum chamber 68 will fall to the bottom of the vacuum chamber due to gravity and are less likely to be sucked into the vacuum source through the vacuum passage 70. The vacuum chamber 68 would then preferably have sufficient volume to collect fluid from an appropriate number of flushings of the reaction chambers 12 on the biochip 6 without filling the vacuum chamber 68. Overfilling of the vacuum chamber 68 can result in the collected fluid leaking back out of the vacuum ports 66 onto the biochip 6 or interfering with the vacuum passage 70, blocking or inhibiting the removal of fluid from the biochip or collection of such fluid. The vacuum chamber is preferably emptied of collected fluids between uses or before insertion of the next biochip for flushing.

Most of the components of the biochip holder 60, including the vacuum chamber 68, receiving means, and the vacuum ports 66 are preferably made of plastic or similar material that resists chemical attack and reaction and is lightweight.

In one embodiment of the present invention, as shown in FIGS. 2 and 3, a biochip holder apparatus 60 is generally a base 62 having receiving means, preferably parallel rails 64, for receiving the biochip 10 such that the outlet ports 16 on the biochip are preferably downhill from the inlet ports 14, allowing fluid to flow due to gravity out of the outlet ports. The base 62 additionally includes at least one vacuum port 66, in communication with the biochip 6, as shown in FIG. 3. Fluid exits the outlet port 16 and then enters the vacuum port 66. The vacuum port 66 is also preferably downhill from the outlet port 16. Fluid entering the vacuum port 66 flows into a vacuum chamber 68 located within the base 62 and in fluid communication with the vacuum port 66. In a preferred embodiment, the base includes a separate vacuum port 66 for each outlet port 16 of the biochip 6. The vacuum ports 66 are preferably aligned with the outlet ports 16 when the biochip is fully inserted as to minimize the travel of the exiting fluid before entering the vacuum chamber 68.

As shown in FIG. 2, the base 62 of the biochip holder 60 has a top surface 76 and a bottom surface 72. The bottom surface 72 rests on a work surface such as a lab bench or table. On the top surface 76, parallel rails 64 create a channel 74 to receive the biochip into the base 62. The parallel rails 64 act as means for receiving the biochip 6 in the base 62. The parallel rails 64 are preferably grooves integrated into the base 62 of sufficient length and width to receive the edges of the biochip 6 while allowing the majority of the biochip surface to be exposed and accessible. Other forms of receiving means could be used for the biochip holder including, but not limited to, an inset in which the biochip could be placed, spring loaded devices, tabs, snaps, leaf springs, or adhesive. The receiving means are preferably located on the top surface 76 of the base 62 so that the biochip is generally exposed, as shown in FIGS. 2 and 3.

The receiving means, such as parallel rails 64, preferably hold the biochip 6 at an angle with respect to the bottom surface 72 of the base 62. It should be noted that while it is preferable that the biochip be at an angle, it is not required and the invention can still be applied to biochip holders where the biochip is held generally parallel to the bottom surface of the base, as shown in further embodiments. In a preferred embodiment, the biochip 6 is at about a 10-30 degree angle, preferably about a 15-25 degree angle, most preferably at about a 20 degree angle from the bottom surface 72 of the base, such that when the base 62 is set on a table or work surface the biochip 6 itself will be angled, allowing gravity to pull the fluid toward the vacuum ports 66. The angling of the biochip can be accomplished in various ways including, but not limited to, having the receiving means or parallel rails lie in a plane at the desired angle within the base, having the top surface of the base itself angled, or assembling components of the base such that the rails lie in a plane angled from the bottom of the base.

The base 62 can be one continuous piece or can be made up of more than one component. In the embodiment shown in FIG. 3 with like numerals representing like structures, the base 62 includes numerous parts including a tilt base 80, which has a bottom surface 72 and an interface surface 82 which is angled compared to the bottom surface, and a biochip receptacle 84 being generally rectangular in shape, which rests on the angled interface surface 82. The vacuum ports 66 and vacuum chamber 68 are likewise located in the biochip receptacle 84 portion of the base 62. However, the entire base 62, including the parallel rails 64 or other receiving means could easily also be made of one continuous molded piece or from several more pieces.

It is to be understood that if the biochip 6 is held on an angle during flushing, it is preferable that such angle allow the gravitational fluid flow from the biochip to be directed toward the vacuum ports 66, generally downhill. As the bottom surface 72 of the base is likely to be on a surface generally perpendicular to the directional force of gravity, the biochip 6 will preferably be placed at an acute angle relative to the bottom surface 72 of the base.

As shown in FIG. 3, the vacuum ports 66 are located in the base 62 such that when the biochip 6 is fully received in the channel 74 and receiving means, such as parallel rails 64, the vacuum ports 66 preferably align with the outlet ports 16, minimizing the distance the fluid must travel to enter the vacuum chamber 68. It is preferred that a vacuum port 66 is present for each outlet port 16 as that will minimize the travel of fluid from each outlet port 16, expedite collection, and increase the chances of avoiding cross-contamination. Application of a vacuum source (not shown) in communication with vacuum ports 66 acts to more quickly pull the fluid through the vacuum ports also decreasing chances of cross-contamination.

As shown in FIGS. 2 and 3, the vacuum chamber 68 is preferably integrated into the base 62. The vacuum chamber 68 is in fluid communication with the vacuum ports 66, and hence the surface of the biochip 6 via the vacuum ports. The vacuum chamber 68 is also in communication with the vacuum passage 70, which leads to the vacuum source, preferably via an external vacuum flask (not shown). The vacuum source acting on the biochip holder via the vacuum flask draws flush fluid from the vicinity of the outlet ports 16, into the vacuum ports 66, which lead into the vacuum chamber 68. As would be understood by one skilled in the art, the fluid is then preferably sucked out of the vacuum chamber 68 through the vacuum passage 70, through tubing leading to the external vacuum flask where the fluid would come to rest and be collected, as previously described.

Use of this preferred embodiment occurs as follows. The biochip holder 60 is placed on a working surface or support surface. The biochip 6, which is desired to be flushed, is inserted into the parallel rails 64 or receiving means of the biochip holder 60, as shown in FIG. 2. Once the biochip is fully inserted into the holder as shown in FIG. 3, flushing of each reaction chamber 12 occurs by the introduction of fluid into the inlet port 14 of each reaction chamber. Introduction of the fluid then causes exiting of the flush fluid from the outlet port 16. The exiting fluid is directed preferably downhill to a vacuum port 66, which is in close proximity to the outlet port 16. The vacuum source (not shown) can be activated at any time during use of the holder, but preferably is started before the actual flushing occurs to minimize the chance of exiting fluid flowing anywhere other than into the vacuum ports 66. The vacuum source acts upon the vacuum chamber 68 and hence the vacuum ports 66 to more quickly and completely draw the exiting fluid through the vacuum ports 66 and into the vacuum chamber 68. The fluid preferably continues to be drawn by a vacuum force through the vacuum passage 70 to an external vacuum flask, where it is collected. This is continued until each reaction chamber 12 has been sufficiently flushed. At such point the vacuum source can be turned off and the biochip 6 removed from the biochip holder 10 when desired. It is to be understood that this invention can be adapted or modified for use in automated systems and multiple biochip processing systems.

The biochip holder is preferably made up of more than one component. Such holders are preferred because they can have one or more of the following advantages: they are easier to fabricate; easier to clean; allow the user to place the biochip receptacle flat on a lab bench for loading; and enable the user to hold the biochip receptacle in one hand, separate from the entire biochip holder, while peeling the various layers from the biochip itself with the other hand.

In another embodiment of the present invention, as shown in FIG. 4, a biochip holder apparatus 260 is generally made up of several interlocking and stacking members. With like numbers representing like structures; the preferably generally rectangular biochip receptacle 284 contains receiving means (not shown), preferably snap means, which securely hold the biochip(s) in place. The biochip receptacle 284 then fits over and on top of port plate 267 which contains at least one vacuum port 266. The biochip receptacle 284 and port plate 267 then fit on top of chamber plate 269 which includes vacuum chamber 268 and vacuum passage 270.

The biochip receptacle 284 is preferably rectangular having a width sufficient to accommodate the length of a biochip 6. The biochip receptacle 284 preferably can hold several biochips simultaneously along the length of the receptacle, as shown in FIG. 4. The bottom surface 285 of the biochip receptacle 284 includes receiving means (not shown) for receiving and securely holding the biochips 6 in the receptacle 284. Any number of conventional devices can be held to receive and hold the biochips including, but not limited to, snaps, spring loaded devices, insets, tabs, leaf springs, or adhesives.

The biochip receptacle 284 includes a multiplicity of holes which traverse the entire depth of the biochip receptacle 284 from a top surface 283 to a bottom surface 285. The holes include inlet holes 287 and outlet holes 289. The biochips are inserted into the receiving means of the biochip receptacle such that the top of the biochip and its inlet ports 14 and outlet ports 16 are aligned with the inlet holes 287 and outlet holes 289, respectively, on the bottom surface 285 of the biochip receptacle 284. As such, each inlet hole 287 is aligned with each inlet port 14 of the biochip 6 and each outlet hole 289 is aligned with each outlet port 16. The introduction of fluid, preferably by pipette 200, is done through an inlet hole 287 which leads to an inlet port 14 on the biochip 6.

The port plate 267 is also preferably rectangular having similar dimensions to the biochip receptacle 284 such that the receptacle 284 can preferably be placed over and on top of the port plate 267. When the receptacle 284 is placed over the port plate 267, vacuum ports 266 in the plate are generally aligned with the outlet holes 289 of the receptacle 284 and the outlet ports 16 of the biochip. The vacuum ports 266 traverse the depth of the port plate 267. Preferably, elastomeric contact rings 263 are generally inserted in the vacuum ports 266 on the biochip side to enhance the seal between the vacuum port 266, the biochip 6 and the biochip receptacle 284.

The chamber plate 269 is also preferably rectangular having similar dimensions to the biochip receptacle 284 and port plate 267 such that the receptacle 284 and port plate 267 can preferably be placed over and on top of the vacuum plate 269. Vacuum plate 269 includes vacuum chamber 268 which is preferably a groove in the plate. The groove, however, does not traverse the entire chamber plate, but rather creates the vacuum chamber 268 in the chamber plate 269. The vacuum chamber 268 is preferably designed such that each vacuum port 266 is in fluid communication with the vacuum chamber 268, such that fluid coming from the outlet ports 16, through the contact rings 263, through the chamber ports 266 will then enter the vacuum chamber 268. The vacuum chamber is also connected to a vacuum passage 270 which leads from the vacuum chamber 268 through the chamber plate 269. The vacuum passage leads to the vacuum source, preferably via an external vacuum flask (not shown).

The vacuum source acting on the biochip holder 260 via the vacuum flask draws flush fluid out of the outlet ports 16 through the contact rings 263 into the vacuum ports 266 which lead to the vacuum chamber 268. As would be understood by one skilled in the art, the fluid is then preferably sucked out of the vacuum chamber 268 through the vacuum passage 270, through tubing leading to the external flask where the fluid would come to rest and be collected, as previously described.

Use of this preferred embodiment occurs as follows. At least one biochip 6 is inserted into the receiving means (not shown) of the biochip receptacle 284 such that the inlet ports 14 of the biochip 6 align with the inlet holes 287 of the receptacle 284 and the outlet ports 16 align with the outlet holes 289. The receptacle 284 is then placed on top of the port plate 267 which is on top of the chamber plate 268 such that the holes 287 and 289 of the receptacle 284 align with the ports 14 and 16 of the biochip 6, the contact rings 263, the vacuum ports 266 and the vacuum chamber 268. Once assembled, flushing of each reaction chamber 12 occurs by the introduction of fluid into the inlet port 14 of each reaction chamber. Fluid is preferably introduced via a pipette 200, through an inlet hole 287 leading to the inlet port 14.

Introduction of the fluid then causes exiting of the flush fluid from the outlet port 16. The outlet hole 289 allows air in the vicinity of the outlet port 16 of the biochip 6. The air entering from outlet hole 289 raises the air velocity as the air passes above the outlet port 16, thus drawing fluid with it toward the vacuum port 266. This eliminates the need for angling of the biochip relative to gravity to pull the fluid away from the port, as is preferable in the previous embodiment. The vacuum source (not shown) can be activated at any time during use of the holder, but preferably is started before the actual flushing occurs to minimize the chance of exiting fluid flowing anywhere other than into the vacuum ports 266. The vacuum source acts upon the vacuum chamber 268 and hence the vacuum ports 266 to more quickly and completely draw the exiting fluid through the vacuum ports and into the vacuum chamber 268. The fluid preferably continues to be drawn by a vacuum force through the vacuum passage 270 to an external vacuum flask, where it is collected. This is continued until each reaction chamber 12 has been sufficiently flushed. At such point, the vacuum source can be turned off and the biochip 6 removed for the biochip holder 260 when desired. It is to be understood that this invention can be adapted or modified for use in automated systems or numerous arrays of multiple biochip processing systems.

The present invention additionally includes a method of collecting exiting flush fluid from a biochip. The biochip 6 is first inserted into the biochip holder 60, preferably in the receiving means, such as parallel rails 64. The biochip 6 is then flushed with the appropriate fluid by insertion of such fluid into the inlet port 14. The resulting fluid exiting the outlet port 16 is then pulled toward vacuum ports 66 which are in communication with a vacuum chamber 68 by way of force created by a vacuum source acting on the vacuum chamber 68 through a vacuum passage 70. The fluid is then collected, preferably in an external vacuum flask connected by hose to the vacuum passage, or in the vacuum chamber itself.

In addition to collection of the flushing fluid, the biochip holder 60 has additional functions and uses. Retaining means are integrated into the biochip holder to keep the biochip from sliding out accidentally during flushing of the biochip or handling of the biochip, including removal of the label layer and/or the flexible layer after flushing. Removal of the various layers requires some force which can be awkward and botched if done when holding the biochip by hand. As such, the biochip holder 60 includes retaining means 90, as shown in FIG. 2, which hold the biochip 6 in the biochip holder 60 and assert tension on the biochip during flushing and handling. The force required to remove the label layer or the flexible layer should not be so high as to make it difficult for the user to remove the biochip, yet sufficient to securely hold the biochip during flushing and removal of the various layers, avoiding accidental removal from the holder. One way to accommodate such needs is to allow the force required to remove the label to exceed the friction force capability of the retaining means if such force is applied parallel to the plane of the parallel rails 64, requiring the peeling of various layer to be done at an angle relative to the parallel rails 64.

The retaining means 90 is in communication with the biochip 6 when it is fully inserted into the receiving means or parallel rails 64 to hold the biochip in that position. Therefore, the retaining means 90 is preferably located in or near the receiving means or in the channel 74 on the top surface 76 of the base 62. One of the preferred retaining means is a retaining roller 92, which includes a cylindrical roller (not shown) surrounded by an o-ring 94. As shown in FIG. 2, the channel 74 defined by the receiving means or parallel rails 64 preferably includes at least one recess 96 in which the retaining roller 92 is then inserted. An o-ring 94 is then placed around the roller. The roller surrounded by the o-ring 94 is positioned in the recess 96 in the channel 74 of the biochip holder 60 such that a 0.014" interference with the bottom surface of the biochip substrate 10, close to the end of the channel is achieved.

Other retaining means are possible including blocking the entrance to the receiving means or parallel rails 64, integrating the retaining means into the receiving means as by clips or resilient material, such as a leaf spring or snap, making up the receiving means, pushing the biochip into position by clamp or spring loaded receiving means, or other similar means. The retaining means in conjunction with the receiving means preferably resist force in all directions so the biochip cannot be lifted up (vertically) out of the holder nor easily slide horizontally out of the holder. The retaining means should be sufficient to resist force while removing various layers but not so great as to cause problems in removal of the biochip when desired.

The foregoing description of the preferred embodiments of the invention have been presented for purposes of illustration and description, and it is not intended to be exhaustive or to limit the invention to the precise embodiment disclosed. It is intended that the scope of the invention not be limited by the specification, but be defined by the claims as set forth below.

The invention claimed is:

1. A biochip and a biochip holder comprising:
- a biochip including at least one outlet port; and
- a biochip holder, the biochip holder including:
  - a biochip receiver including parallel rails;
  - at least one vacuum port adapted to connect a vacuum source to said at least one outlet port; and
  - a base having a bottom surface, the receiver being configured to position the biochip at an acute angle relative to the bottom surface of the base.

2. The biochip and biochip holder of claim 1, wherein said at least one outlet comprises a multiplicity of outlet ports and said at least one vacuum port comprises a multiplicity of vacuum ports, the outlet ports and vacuum ports being aligned when the biochip is received in the holder.

3. A biochip and biochip holder, the biochip holder comprising:
- a base having a bottom surface and parallel rails for receiving a biochip; wherein the parallel rails position the biochip at an angle to the bottom surface of the base; and at least one vacuum port located in the base, said vacuum port adapted to connect a vacuum source to a surface of the biochip.

4. The biochip and biochip holder of claim 3, wherein the biochip is at an approximately 20 degree angle relative to the bottom surface of the base.

5. A biochip and biochip holder comprising:

a biochip having at least one fluid port; and a biochip holder including:

a biochip receiver having parallel biochip receiving rails;

at least one vacuum port in communication with the biochip fluid port, wherein the vacuum port is adapted to connect a vacuum source to the fluid port of the biochip;

a vacuum chamber in communication with at least one vacuum port;

a vacuum passage in communication with the vacuum chamber such that a vacuum source is connectable to the vacuum chamber via the vacuum passage; and a base having a bottom surface, receiver being configured to position the biochip at an acute angle relative to the bottom surface of the base.

* * * * *